United States Patent [19]

Murphy

[11] Patent Number: 4,993,072

[45] Date of Patent: Feb. 12, 1991

[54] SHIELDED ELECTRET TRANSDUCER AND METHOD OF MAKING THE SAME

[75] Inventor: Preston V. Murphy, Geneva, Switzerland

[73] Assignee: Lectret S.A., Geneva, Switzerland

[21] Appl. No.: 315,505

[22] Filed: Feb. 24, 1989

[51] Int. Cl.[5] ..... H04R 3/00

[52] U.S. Cl. ..... 381/113; 381/191; 307/400

[58] Field of Search ..... 381/113, 191, 116; 307/400 ET

[56] References Cited

U.S. PATENT DOCUMENTS

| | | | |
|---|---|---|---|
| Re. 28,420 | 5/1975 | Murphy . | |
| 4,149,095 | 4/1979 | Poirier et al. | 357/23.12 |
| 4,621,171 | 11/1986 | Wada et al. | 381/113 |
| 4,764,690 | 8/1988 | Murphy et al. | 381/191 |

OTHER PUBLICATIONS

Hohn, D. and Gerhar-Multhaupt, R., "Silicon Dioxide Electret Transducer", *J. Acoust. Soc. Am.*, vol. 75, pp. 1297–1298 (Apr. 1984).

Sprenkeis, A. and Bergveld, P., "Development of a Subminiature Electret Microphone Constructed in Silicon", *Proc. 4th Conf. Solid State Sensors and Actuators, IEEE*, Tokyo, 1987, p. 295.

*Primary Examiner*—Forester W. Isen

[57] ABSTRACT

An electret transducer including a pair of spaced electrodes, one electrode being connected to a preamplifier input, an insulator on the outer surface of the electrode connected to the preamplifier input, and a conductive layer on the other side of the insulator, whereby the conductive layer can be used to shield the electrode to reduce stray capacitance between it and other components of the transducer by connecting the conductive shield to the output of the preamplifier circuit for the transducer. Also disclosd is the use of a silicon backplate with an integrated circuit formed therein, an insulator layer thereon, a conductive layer thereon, and an electret layer thereon, the conductive layer being grounded during poling of the electret to protect the integrated circuit from damage.

9 Claims, 1 Drawing Sheet

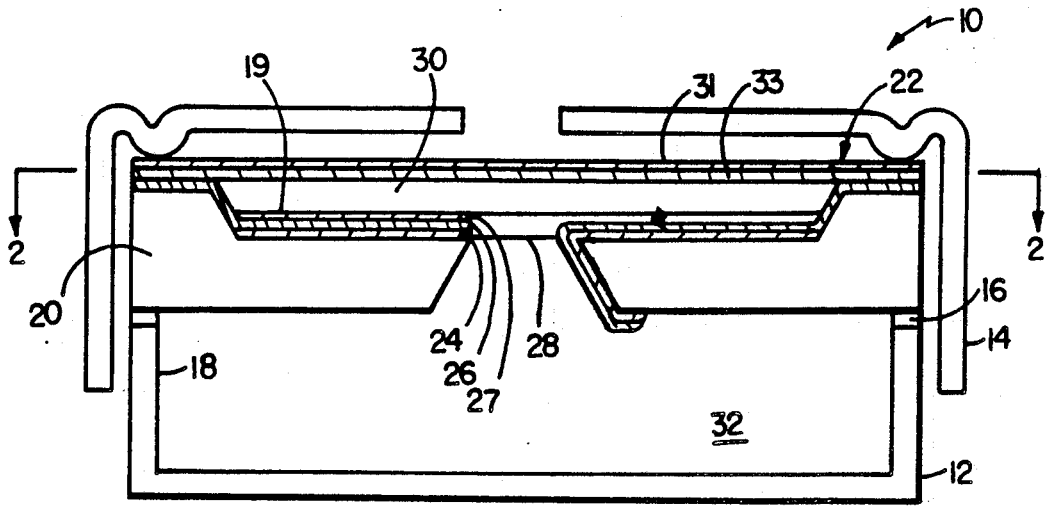
FIG.1
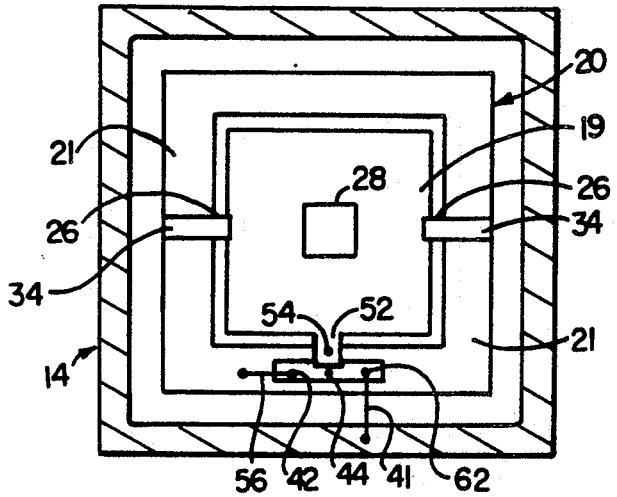
FIG.2
FIG.4
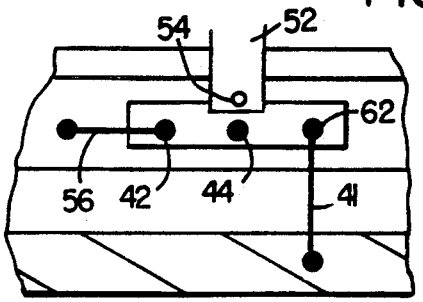
FIG.3
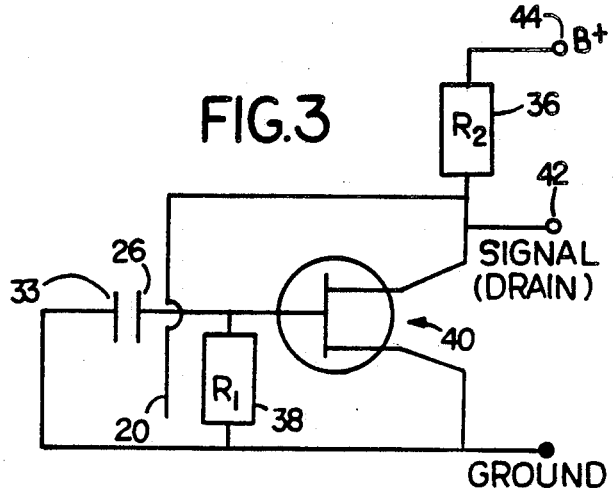

SHIELDED ELECTRET TRANSDUCER AND METHOD OF MAKING THE SAME

BACKGROUND OF THE INVENTION

The invention relates to electret transducers and their manufacture.

Electret transducer microphones include an electret between a pair of spaced, plate-shaped electrodes, one electrode being flexible so that sound waves cause changes in spacing and the electrical characteristics between the two. Electret transducer microphones used in hearing aids typically act as parallel plate capacitors and have a rigid plate electrode that carries an electret for bias and a spaced flexible diaphragm plate electrode. Typically, the rigid plate electrode is directly coupled to a field effect transistor (FET) preamplifier. As hearing aid microphones become smaller, their capacitance becomes smaller, and the effect of stray capacitance on signal loss becomes pronounced. Usually the fixed (i.e., rigid) electrode is connected to the FET gate, and the flexible diaphragm electrode is connected to a ground which is connected to the FET source. To reduce stray capacitance, the gate-connected electrode should be well spaced from ground and grounded supporting members; providing such spacing becomes more difficult as the size of microphones becomes smaller.

Stray capacitance is a problem for both conventional microphones with metal fixed electrodes, often referred to as backplates, and for more recent designs including silicon (which has adequate conductivity to be considered the equivalent of metal) backplates. Examples of the more recent silicon designs are described in Hohm, D. and GerhardMulthaupt, R., "Silicon Dioxide Electret Transducer", *J. Acoust. Soc. Am.*, Vol. 75, pp. 1297–1298 (April 1984), and Sprenkeis, A. and Bergveld, P., "Development of a Subminiature Electret Microphone Constructed in Silicon", *Proc. 4th Conf. Solid State Sensors and Aotuators*, IEEE, Tokyo, 1987, p. 295.

SUMMARY OF THE INVENTION

In one aspect the invention features, in general, providing an insulator on the outer surface of one of the electrodes of an electret transducer and a conductive layer on the other side of the insulator, the conductive layer being connected to the output of a near unity gain amplifier and used to shield the electrode to reduce stray capacitance between the electrode and the other components of the transducer.

In another aspect the invention features, in general, an electret transducer and amplifier circuit in which one of the spaced electrodes of the electret transducer is connected to the gate of a transistor, and there is a conductive member that is spaced from the outer surface of this electrode and is connected to a drain or source of the transistor (whichever carries the output signal) and acts as a shield for the electrode to reduce stray capacitance.

In another aspect the invention features, in general, an electret transducer component that includes a silicon backplate, an amplifier circuit (e.g., a preamplifier) incorporated in the silicon backplate, an insulator on the surface of the backplate facing the diaphragm, a conductive layer on the insulator, and an electret on the conductive layer. During manufacture, the conductive layer can be grounded during poling of the electret to avoid damage to the preamplifier circuit.

Other advantages and features of the invention will be apparent from the following description of a preferred embodiment thereof and from the claims.

DESCRIPTION OF THE PREFERRED EMBODIMENT

The preferred embodiment will now be described.

DRAWINGS

FIG. 1 is a diagrammatic, vertical sectional view of an electret transducer device according to the invention.

FIG. 2 is a diagrammatic, horizontal sectional view, taken at 2—2 of FIG. 1, of the FIG. 1 device.

FIG. 3 is an electrical schematic for the FIG. 1 electret transducer and its integral preamplifier circuit.

FIG. 4 is a close-up view of a portion of FIG. 2.

STRUCTURE

Referring to FIGS. 1 there is shown electret transducer 10. It includes lower metal housing piece 12 and mating upper metal housing piece 14. Supported between the two and on top of insulation 16 on upper wall 18 of lower housing piece 12 are silicon backplate 20 and flexible diaphragm 22. Backplate 20 has a raised peripheral rim 21 to which the periphery of flexible diaphragm 22 is attached, has layer 24 of insulation deposited in its recessed central area 19, layer 26 of metallization (vapor deposited metal or silicon) thereon, and layer 27 of electret thereon. A preamplifier circuit (not shown) is formed as an integrated circuit integrally with backplate 20. Backplate 20 and the layers supported thereon have holes therethrough, one hole being hole 28 shown in FIG. 1, to provide communication between front air chamber 30, between flexible diaphragm 22 and backplate 20, and rear air cavity 32. Flexible diaphragm 22 is made of flexible plastic membrane 33 and metallized layer 31 thereon.

Referring to FIG. 2, metallization 26 includes tabs 34 extending beyond central area 19 and up over peripheral rim 21 to two ends of backplate 20. The integrated circuit preamplifier is shown including the connection 52 leading to gate 54, connection 56 to drain 42 (from silicon backplate 20) and connection 41 to source 62 (from metal housing 14). (This is only a schematic; the circuit is implemented internally in the integrated circuit.)

Referring to FIG. 3, it is seen that the preamplifier circuit includes two resistors 36, 38 and FET 40, all of which are formed integrally with silicon backplate 20 and connected as a source-follower circuit. Metallization layer 26 is electrically connected to the gate of FET 40 and resistor 38. The silicon substrate (electret backplate) 20 is electrically connected to the drain of FET 40, which is also connected to signal node 42 and resistor 36; this is achieved on the physical device shown on FIG. 1 by bulk conduction of silicon. The other terminal of resistor 36 is connected to the voltage source at node 44; this is achieved by a lead to the appropriate location of the integrated circuit in backplate 20. The source of FET 40 and resistor 38 are connected via lead 41 to housing 14, which is at ground and is electrically connected to housing 12 and metallization 33 of flexible diaphragm 22. FET 40 is a PMOS transistor. Resistors 36 and 38 are 25 Kohm and 5 Gohm, respectively.

MANUFACTURE

In manufacture, the backplates and flexible diaphragm units for a plurality of electret transducers 10 are made together on a silicon wafer and thereafter separated from each other. Insulation layer 24 is provided by oxidizing or by chemical vapor deposition of an oxide on selected surface regions on a silicon wafer that has been etched to provide the recessed central area 19 of backplates 20 and processed to provide integrated preamplifier circuits. Selected areas of the upper surface of the silicon wafer are metallized to provided metallization 26 (the selected areas including gate connection 52 and tabs 34) and overcoating with electret film 27. Tabs 34 carry metallized layers 26 to the adjacent units, permitting all metallized layers 26 to be easily grounded while the electrets on all units are poled simultaneously by corona or other conventional techniques, e.g., as described, in Murphy U.S. Reissue Pat. No. Re 28,240. Then the metallized flexible sheet that provides diaphragm 22 is bonded to the wafer at the rim 21 areas; and the wafer is sawed to produced hundreds of microphone chips. By providing the grounding during poling, the FETs incorporated in silicon backplate 20 are protected against damage by over voltage of the poling voltages, which are in excess of 1 kV.

OPERATION

In operation, sound waves cause vibration of flexible diaphragm 22, in turn changing the spacing between it and metallization 26 and thus the voltage applied to the gate of FET 40 by the electret. The signal is amplified by FET 40 and provided at signal node 42. The preamplifier is operated at a small negative voltage gain (i.e., 0.98), and the stray capacitance of the silicon backplate can be reduced to a correspondingly small value. The signal voltage on the backplate support follows the voltage on the metallized surface so the stray capacitance is nulled out. Connection of the signal voltage at the drain of FET 40 to backplate 20 reduces the stray capacitance to about one pF. The flexible diaphragm-/backplate capacitance is about three pF.

OTHER EMBODIMENTS

Other embodiments of the invention are within the scope of the following claims. E.g., other near unity preamplifiers could be used, e.g., those have 1.0±0.1 gain.

What is claimed is:

1. An electret transducer and preamplifier combination comprising a pair of spaced electrodes, one said electrode being a flexible electrode so as to change the spacing between electrodes in response to force on said one electrode, the other said electrode being fixed, an electret between said electrodes, an insulator on the outer surface of the other said electrode, a conductive layer on the other side of said insulator, said conductive layer being a silicon backplate on which said electret and insulator are supported, and a preamplifier having near unity gain, said conductive layer being connected to the output of said preamplifier, whereby said conductive layer can be used to shield said other electrode to reduce stray capacitance between said other electrode and other components of said transducer.

2. The transducer and preamplifier combination of claim 1 wherein said silicon backplate includes an amplifier circuit formed integrally therewith.

3. The transducer and preamplifier combination of claim 1 wherein said silicon backplate includes a peripheral rim, and said flexible electrode is attached at its periphery to said rim.

4. The transducer and preamplifier combination of claim 3 further comprising a conductive housing that is electrically connected to said flexible electrode.

5. An electret transducer and amplifier circuit comprising transistor having source, gate and drain nodes, a pair of spaced electrodes, one said electrode being connected to said gate, another said electrode being connected to one of said drain and source, a said electrode being a flexible electrode so as to change the spacing between electrodes in response to force on said flexible electrode, an electret between said electrodes, and a conductive member spaced from the outer surface of said one electrode being connected to said gate, said conductive member being connected to the other of said drain and source.

6. The transducer and circuit of claim 5 wherein said conductive member is a silicon backplate, and further comprising an insulator layer on said backplate spacing said silicon backplate from said another said electrode.

7. The transducer and circuit of claim 6 wherein said transistor is a field affect transistor formed integrally with said silicon backplate.

8. The transducer and circuit of claim 7 wherein said silicon backplate includes a peripheral rim, and said flexible electrode is attached at its periphery to said rim.

9. The transducer and circuit of claim 8 further comprising a conductive housing that is electrically connected to said flexible electrode.

* * * * *